US011945612B2

(12) United States Patent
Melchionda et al.

(10) Patent No.: US 11,945,612 B2
(45) Date of Patent: Apr. 2, 2024

(54) WRAPPING DEVICE FOR PRODUCT WRAPPERS

(71) Applicant: Azionaria Costruzioni Macchine Automatiche A.C.M.A. S.p.A., Bologna (IT)

(72) Inventors: Marialivia Melchionda, Bologna (IT); Stefano Piazzi, Bologna (IT); Marco Zecchi, Bologna (IT); Andrea Guidetti, Bologna (IT); Luca Matrà, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 18/102,203

(22) Filed: Jan. 27, 2023

(65) Prior Publication Data

US 2023/0242290 A1 Aug. 3, 2023

(30) Foreign Application Priority Data

Jan. 28, 2022 (IT) ..... 102022000001418

(51) Int. Cl.
*B65B 11/34* (2006.01)
*B65B 11/04* (2006.01)
(Continued)

(52) U.S. Cl.
CPC ..... *B65B 11/34* (2013.01); *B65B 11/045* (2013.01); *B65B 11/14* (2013.01); *B65B 25/005* (2013.01);
(Continued)

(58) Field of Classification Search
CPC ..... B65B 11/14; B65B 11/16; B65B 11/24; B65B 11/26; B65B 11/34; B65B 11/36;
(Continued)

(56) References Cited

U.S. PATENT DOCUMENTS 1,743,666 A * 1/1930 Gangler ..... B65B 11/14 53/230
2,046,262 A * 6/1936 Grover ..... B65B 51/00 53/370

(Continued)

FOREIGN PATENT DOCUMENTS

DE 2420190 A1 11/1975
GB 485499 A 5/1938

(Continued)

OTHER PUBLICATIONS

Search Report and Written Opinion Issued in Italian Patent Application No. 202200008726, dated Jan. 24, 2023, 7 pages.

*Primary Examiner* — Joshua G Kotis
(74) *Attorney, Agent, or Firm* — Dilworth IP, LLC

(57) ABSTRACT

A device for wrapping product wrappers including a winder, the winder including a gripper mechanically connected to a tubular shaft rotatable about and translatable along an approach axis, the gripper being rotatable and translatable integrally with the tubular shaft; an actuating rod active on the gripper and movable along an actuating axis, the actuating rod being movable along the actuating axis with respect to the tubular shaft and rotationally constrained to the tubular shaft, wherein the gripper is rotatable and movable following a translation of the actuating rod along the actuating axis; a first electric motor active on the actuating rod to translate the actuating rod along the actuating axis; and a second electric motor active on the tubular shaft to translate the tubular shaft along the approach axis. The device further includes a control unit configured to drive the first electric motor and the second electric motor.

16 Claims, 6 Drawing Sheets

(51) Int. Cl.

| | |
|---|---|
| ***B65B 11/14*** | (2006.01) |
| ***B65B 25/00*** | (2006.01) |
| ***B65B 59/00*** | (2006.01) |
| *B65B 51/00* | (2006.01) |

(52) U.S. Cl.
CPC ..... *B65B 59/001* (2019.05); *B65B 59/003* (2019.05); *B65B 51/00* (2013.01)

(58) Field of Classification Search
CPC ..... B65B 11/44; B65B 11/46; B65B 13/28; B65B 25/005
USPC ..... 53/370
See application file for complete search history.

(56) References Cited

U.S. PATENT DOCUMENTS

| | | | | | |
|---|---|---|---|---|---|
| 3,968,628 | A * | 7/1976 | Seragnoli | B65B 11/34 | 269/228 |
| 4,539,790 | A | 9/1985 | Zamboni | | |
| 5,481,849 | A * | 1/1996 | Spatafora | B65B 51/00 | 53/227 |
| 5,807,378 | A * | 9/1998 | Jensen | B25J 15/04 | 606/1 |
| 6,080,181 | A * | 6/2000 | Jensen | A61B 34/76 | 606/205 |
| 10,807,250 | B2 * | 10/2020 | Chalk | B25J 15/086 | |
| 2002/0058929 | A1 * | 5/2002 | Green | H04N 13/341 | 348/E13.016 |
| 2012/0215358 | A1 * | 8/2012 | Gettings | B25J 19/023 | 294/213 |

FOREIGN PATENT DOCUMENTS

| | | | |
|---|---|---|---|
| GB | 808881 | A | 2/1959 |
| GB | 1271195 | A | 4/1975 |
| GB | 1582822 | A | 1/1981 |
| GB | 2087830 | A | 6/1982 |

* cited by examiner

WRAPPING DEVICE FOR PRODUCT WRAPPERS

FIELD OF THE INVENTION

The present invention relates to a wrapping device for product wrappers, in which such wrapping includes involves twist or preferably double twist closure of the wrapper.

BACKGROUND

The present invention is used in the manufacturing sector, for example in the food industry, to wrap products, preferably confectionery products such as chocolates, candies, sugared almonds and the like.

Twist or double twist product closures are obtained from usually rectangular sheets of wrappers at the centre of each of which a respective product to be wrapped is placed. The wrapper is then folded over the product so as to obtain a tubular shape of the wrapper. Next, (one end or) both ends of the wrapper are twisted to form (one or) two end twists.

In order to ensure repeatable wrapping and high production rates, automated devices have been developed which are capable of twisting one or both ends of the wrapper to achieve the aforementioned twist or double twist closure.

Document U.S. Pat. No. 4,539,790A describes a device for double-twist wrapping sweets or the like comprising a wheel with a horizontal axis of rotation in continuous motion on whose circumferential surface are mounted handling equipment configured to retain products wrapped in a tubular wrapper. Two twisting devices act on opposite sides of the handling equipment to twist the ends of the tubular wrapper. Each twisting device comprises a gripping element which can be driven in opening and closing to grasp and release one end of the tubular wrapper. The gripping element is mounted at the end of a sleeve inside which a rack rod slides. The sliding of the rack rod in the sleeve determines the opening and closing of the gripping element. The sleeve slides along a sliding axis approaching and receding from the handling equipment and can be rotated about the sliding axis. The sliding of the rack rod inside the sleeve and the sliding of the sleeve along the sliding axis are performed by means of a connection with followers inserted in cam tracks obtained in a single control body placed in rotation. Thereby, the sleeve can be slid in and out of the handling equipment together with the rack rod to allow the gripping element to reach and recede from the end of the tubular wrapping, and the rack rod can be slid inside the sleeve to open and close the gripping element.

SUMMARY

The Applicant has noted that there is an increasing need in the product wrapping sector to be able to use different wrapping materials and to be able to make different configurations of twists or double twists.

The Applicant has verified that different wrapping materials can require different closing degrees of the gripping element (i.e., mutual approaching between the parts of the gripping element) in order not to damage the wrapper and to ensure that it can be twist closed.

The Applicant has also verified that different configurations of double twists, even with the same wrapping material, can require different initial moments of gripping and rotating the two gripping elements. For example, it may be necessary to start twisting one tubular end of the wrapper at a different time with respect to the other tubular end.

The Applicant has noted that a double-twist wrapping device such as the one described in U.S. Pat. No. 4,539,790A is capable of making twists or double twists which are always identical to each other and from only one type of wrapping material or from very similar types of wrapping materials.

Indeed, the Applicant has verified that following a change in the type of wrapping material, a double-twist wrapping device such as the one described in U.S. Pat. No. 4,539,790A could apply an inadequate closing force on the gripping elements, i.e., insufficient to hold the tubular ends during the twist wrapping or such as to ruin the wrapping during the twist wrapping.

The Applicant also verified that following a change in the type of double-twist configuration, a double-twist wrapping device such as the one described in U.S. Pat. No. 4,539,790A would not be able to handle several initial moments of gripping and rotating the two gripping elements.

The Applicant has envisaged that it would be possible to design and produce control bodies with pairs of cam tracks adapted to make the gripping elements follow a law of motion suitable for a specific twist or double twist configuration or suitable for operating on a specific type of wrapping material. By replacing the control bodies, it would be possible to reconfigure the operation of the device to operate on a specific wrapping material and to make a specific twist or double twist wrapper.

However, the Applicant has noted that although it would theoretically be possible to have any number of control bodies with respective pairs of cam tracks, it would be practically impossible to have predetermined pairs of cam tracks, whereby for any wrapper material and for any twist or double twist configuration a respective pair of cam tracks is included.

The Applicant has also noted that, even if a control body with the appropriate pair of cam tracks was available to make the gripping element follow the correct law of motion, the replacement of the control body would require non-negligible downtimes to perform the replacement, which would increase the production costs of the final product.

Again, the Applicant has verified that it is not always possible to predetermine with adequate precision the law of motion of the gripping element in order to obtain a particular double twist configuration (and thus the exact shape of the cam paths which must cooperate, on the same control body, to reproduce such a law of motion) since it is often necessary to proceed by successive approximations in order to reach the exact law of motion.

Therefore, the present invention relates to a wrapping device for product wrappers.

Preferably, a winder is provided.

Preferably, the winder comprises a gripper mechanically connected to one end of a tubular shaft.

Preferably, said tubular shaft is rotatable around and translatable along said approach axis.

Preferably, said gripper is rotatable and translatable integrally with said tubular shaft.

Preferably, the winder comprises an actuating rod, active on said gripper.

Preferably, the actuating rod slides along an actuating axis parallel to, or coinciding with, said approach axis.

Preferably, said actuating rod slides along said actuating axis in relation to said tubular shaft and is rotationally constrained to said tubular shaft.

Preferably, said gripper can be opened and closed following the actuating rod being moved along the actuating axis.

Preferably, the winder comprises a first electric motor active on said actuating rod to move said actuating rod along the actuating axis.

Preferably, the winder comprises a second electric motor active on said tubular shaft to move said tubular shaft along the approach axis.

Preferably, a control unit is included which is configured to drive the first electric motor and the second electric motor.

The Applicant has noted that it is possible, from predetermined parameters, to reconstruct or interpolate the overall law of motion which the gripper must perform in order to operate on a given type of wrapper material or a predetermined twist configuration.

The Applicant has also noted that the overall law of motion to be performed by the gripper can be broken down into the individual laws of motion of the actuating rod and the tubular shaft.

The Applicant has perceived that by decoupling the actuator driving the actuating rod from the actuator driving the tubular shaft, it is possible to give each actuator its own individual law of motion.

The Applicant has further perceived that it is possible to use two independent electric motors to drive the actuating rod and the tubular shaft, respectively, and that each of the two electric motors can be given its own individual law of motion by commands from the control unit.

The Applicant has found that this allows individual laws of motion to be implemented with each electric motor without the need for downtime, simply by giving each electric motor a specific law of motion.

The Applicant has also found that the individual laws of motion which can be imparted to each electric motor are essentially infinite, thus making it possible to create an essentially infinite number of overall laws of motion for the gripper. This makes it possible to create essentially any twist configuration with essentially any type of wrapper material, clearly within the limits of physically permissible configurations and materials.

The Applicant has also found that by varying the torque of the electric motor associated with the actuating rod, it is possible to vary the pressure which the gripper exerts on the wrapper during a wrapper closing operation, enabling the closing of particular wrapper materials or the creation of particular closing twists.

The Applicant has further found that during the start-up and shut-down transients of the device, it is possible to vary the laws of motion of the actuating rod and the tubular shaft to adapt them to the increasing (or decreasing) winding speed of the wrapper, thus avoiding production waste during the start-up and shut-down transients.

In the present description and subsequent claims, the term 'law of motion' refers to one or more relations which describe the motion of a physical system. The physical system referred to in the present description and subsequent claims is the gripper (when referring to a law of motion of the gripper) or the tubular shaft (when referring to the law of motion of the tubular shaft) or the actuating rod (when referring to the law of motion of the actuating rod). For example, the law of motion can be represented by a mathematical function or diagram describing the position of an object (i.e., of the gripper or its components, the actuating rod or the tubular shaft) as a function of time, alternatively or in combination it can be represented by a mathematical function or diagram describing the velocity of an object (i.e., of the gripper or its components, the actuating rod or the tubular shaft) as a function of time, alternatively or in combination can be represented by a mathematical function or diagram describing the acceleration of an object (i.e., the gripper or its components, the actuating rod or the tubular shaft) as a function of time.

The present invention can have at least one of the preferred features described below. Such features can be present singly or in combination, unless expressly stated otherwise, in the wrapping device of the present invention.

Preferably, a third electric motor active on said tubular shaft is provided to rotate said tubular shaft about the approach axis.

Preferably, said control unit is configured to drive the third electric motor.

Preferably, a transmission shaft is provided which is connected to said third electric motor.

Preferably, the drive of the third electric motor causes the transmission shaft to rotate about a transmission axis.

Preferably, the transmission axis is parallel to the approach axis.

Preferably, a pinion is keyed to said transmission shaft to rotate with said transmission shaft.

Preferably, a spur gear is keyed to said tubular shaft and is geared directly or indirectly with said pinion.

Preferably, the gripper comprises a first jaw and a second jaw provided with a first toothed wheel and a second toothed wheel, respectively.

Preferably, the first toothed wheel and the second toothed wheel are rotatable, together with the corresponding first and second jaw, about a clamping axis perpendicular to the actuating axis.

Preferably, the actuating rod comprises a rack geared with the first toothed wheel and the second toothed wheel.

Preferably, a translation in a first direction of the actuating rod along the actuating axis results in a rotation of the first toothed wheel in a first angular direction and a rotation of the second toothed wheel in a second angular direction.

Preferably, a rotation of the first toothed wheel in a first angular direction and a rotation of the second toothed wheel in a second angular direction causes the first jaw and the second jaw of the gripper to close.

Preferably, a translation in a second direction, opposite the first direction, of the actuating rod along the actuating axis results in a rotation of the first toothed wheel in a second angular direction and a rotation of the second toothed wheel in a first angular direction.

Preferably, a rotation of the first toothed wheel in a second angular direction and a rotation of the second toothed wheel in a first angular direction results in the opening of the first jaw and the second jaw of the gripper.

Preferably, said winder comprises a first fork.

Preferably, said first fork is connected to a drive shaft of the first electric motor.

Preferably, said first fork is constrained in translation along the actuating axis to said actuating rod.

Preferably, said first fork is driven directly or indirectly by the first electric motor to move said actuating rod along the actuating axis.

Preferably, said actuating rod is rotatable about said actuating axis with respect to said first fork.

Preferably, in a first embodiment the drive shaft of the first electric motor is a rotating drive shaft.

Preferably, in this case the first electric motor produces a mechanical moment on said drive shaft selectively directed in a first angular direction and in a second angular direction.

Preferably, in the first embodiment, said winder comprises a first control rod having a first end hinged to the first fork and a second end connected to the drive shaft of the first electric motor.

Preferably, a main extension axis of the first control rod and the drive shaft of the first electric motor are arranged perpendicular to each other.

Preferably, a speed reducer is interposed between the drive shaft of the first electric motor and the first control rod, which is configured to transmit a lower rotational speed to the first rod with respect to the rotational speed of the drive shaft of the first electric motor.

Preferably, said first control rod moves the actuating rod along the actuating axis.

Preferably, in the first embodiment said drive shaft of the first electric motor is driven to rotate in a first angular direction and translate the actuating rod in a first direction along the actuating axis.

Preferably, in the first embodiment said drive shaft of the first electric motor is driven to rotate in a second angular direction opposite to the first and translate the actuating rod in a second direction along the actuating axis.

Preferably, in a second embodiment, the first electric motor is a linear electric motor and comprises a translatable drive shaft.

Preferably, the linear electric motor produces a force on said translatable drive shaft selectively directed in a first direction and in a second direction.

Preferably, said translatable drive shaft is parallel to the actuating axis of the actuating rod.

Preferably, in the second embodiment said drive shaft of the first electric motor is driven to translate the actuating rod in a first direction along the actuating axis.

Preferably, in the second embodiment, said drive shaft of the first electric motor is driven to translate the actuating rod in a second direction along the actuating axis.

Preferably, said winder comprises a second fork.

Preferably, said second fork is connected to a drive shaft of the second electric motor.

Preferably, said second fork is constrained in translation along the approach axis to said tubular shaft.

Preferably, said second fork is driven directly or indirectly by the second electric motor to move said tubular shaft along the approach axis.

Preferably, said tubular shaft is rotatable about said approach axis with respect to said second fork.

Preferably, in a first embodiment the drive shaft of the second electric motor is a rotating drive shaft.

Preferably, in this case the second electric motor produces a mechanical moment on said transmission shaft selectively directed in a first angular direction and in a second angular direction.

Preferably, in the first embodiment, said winder comprises a second control rod with a first end hinged to the second fork and a second end connected to the drive shaft of the second electric motor.

Preferably, a main extension axis of the second control rod and the drive shaft of the second electric motor are arranged perpendicular to each other.

Preferably, a speed reducer is interposed between the drive shaft of the second electric motor and the second control rod, which is configured to transmit a lower rotational speed to the second rod with respect to the rotational speed of the drive shaft of the second electric motor.

Preferably, said second control rod moves the tubular shaft along the approach axis.

Preferably, in the first embodiment said drive shaft of the second electric motor is driven to rotate in a first angular direction and translate the tubular shaft in a first direction along the approach axis.

Preferably, in the first embodiment said drive shaft of the second electric motor is driven to rotate in a second angular direction opposite the first and translate the tubular shaft in a second direction along the approach axis.

Preferably, in a second embodiment the second electric motor is a linear electric motor and comprises a translatable drive shaft.

Preferably, the linear electric motor produces a force on said translatable drive shaft selectively directed in a first direction and in a second direction.

Preferably, said translatable drive shaft is parallel to the approach axis of the tubular shaft.

Preferably, in the second embodiment, the drive shaft of the second electric motor is driven to translate the tubular shaft in a first direction along the approach axis.

Preferably, in the second embodiment, the drive shaft of the second electric motor is driven to translate the tubular shaft in a second direction along the approach axis.

Preferably, said control unit is configured to generate a first control signal and send it to a driver of the first electric motor.

Preferably, said control unit is configured to generate a second control signal and send it to a driver of the second electric motor.

Preferably, said control unit is configured to generate a third control signal and send it to a driver of the third electric motor.

Preferably, the first control signal and the second control signal are generated so that the translation of the actuating rod and the translation of the tubular shaft are coordinated to achieve a predetermined movement of the gripper.

Preferably, the third control signal is generated so as to coordinate the translation of the actuating rod and the translation of the tubular shaft with the rotation of the tubular shaft to achieve a predetermined movement and rotation of the gripper.

Preferably, a user data entry interface is included which is configured to receive at least one input data representative of a desired gripper operating parameter.

Preferably, said desired gripper operating parameter is chosen from at least one of the following: translation of the tubular shaft along the approach axis in a first direction; translation of the tubular shaft along the approach axis in a second direction; point, along the approach axis, at which a closing movement of the first jaw and the second jaw of the gripper begins; point, along the approach axis, at which a closing movement of the first jaw and the second jaw of the gripper ends; point, along the approach axis, at which an opening movement of the first jaw and the second jaw of the gripper begins; point, along the approach axis, at which an opening movement of the first jaw and the second jaw of the gripper ends; stroke of the tubular shaft along the approach axis during which a complete closure of the first jaw and the second jaw of the gripper occurs; stroke of the tubular shaft along the approach axis during which the complete opening of the first jaw and second jaw of the gripper occurs; maximum opening rotation of the first jaw and second jaw of the gripper; maximum closing rotation of the first jaw and second jaw of the gripper; clamping torque of the first jaw and second jaw of the gripper.

Preferably, said control unit is configured to determine a law of motion of the gripper from said at least one desired operating parameter.

Preferably, the law of motion of the gripper is a mathematical function which describes the position of at least one representative point of the gripper as a function of time.

Alternatively or in combination, the law of motion of the gripper is preferably a mathematical function which describes the position of one or more representative points of the first and second jaws of the gripper as a function of time.

Preferably, said control unit is configured to interpolate at least one desired operating parameter with preset operating parameters to determine said law of motion of the gripper from the result of said interpolation.

Preferably, such preset operating parameters are predetermined and set in the control unit by the manufacturer, e.g., stored in a memory of the control unit as system parameters. Preferably, said preset operating parameters are representative of positions which the gripper must necessarily reach over time in order to obtain the desired behaviour.

Preferably, said at least one desired operating parameter can be represented with a plurality of points representative of the desired position of the gripper in time.

Preferably, said preset operating parameters can be represented with a plurality of points representative of the required position of the gripper in time.

Preferably, said law of motion is obtained by interpolating said plurality of points representative of the required position of the gripper in time and said plurality of points representative of the desired position of the gripper in time.

Preferably, said control unit is also configured to determine, from said law of motion of the gripper, a first law of motion of the actuating rod and a second law of motion of the tubular shaft.

Preferably, the first law of motion of the actuating rod is a mathematical function which describes the position of at least one representative point on the actuating rod as a function of time.

More preferably, the first law of motion of the actuating rod is a mathematical function describing the position of at least one representative point of the actuating rod along the actuating axis as a function of time.

Preferably, the second law of motion of the tubular shaft is a mathematical function which describes the position of at least one representative point on the tubular shaft as a function of time.

More preferably, the second law of motion of the tubular shaft is a mathematical function which describes the position of at least one representative point of the tubular shaft along the approach axis as a function of time.

Preferably, said first control signal is representative of the first law of motion of the tubular shaft.

Preferably, said control unit is configured to generate said first control signal representative of the first law of motion and send it to said driver of the first electric motor.

Preferably, said second control signal is representative of the second law of motion of the tubular shaft.

Preferably, said control unit is configured to generate said second control signal representative of the second law of motion and send it to said driver of the second electric motor.

Preferably, said third control signal is representative of the rotation speed of the tubular shaft.

Preferably, said user data entry interface is also configured to receive at least one further data entry item representing the rotation speed of the gripper.

Preferably, the rotation speed of the gripper coincides with the rotation speed of the tubular shaft.

Preferably, a further winder is provided.

Preferably, the further winder is used in combination with said winder to make a double twist wrapper, in which a twist wrapper is made at each of the opposite ends of the wrapper.

Preferably, the further winder is identical in structure and operation to said winder.

Preferably, the further winder comprises a further gripper mechanically connected to one end of a further tubular shaft.

Preferably, said further tubular shaft is rotatable about a further approach axis and translatable along said further approach axis.

Preferably, said further gripper is rotatable and translatable integrally with said further tubular shaft.

Preferably, said further winder comprises a further actuating rod, active on said further gripper.

Preferably, the further actuating rod slides along a further actuating axis parallel to, or coinciding with, said further approach axis.

Preferably, said further actuating rod slides along said further actuating axis with respect to said further tubular shaft and is rotationally constrained to said further tubular shaft.

Preferably, said further gripper can be opened and closed following the further actuating rod being moved along the further actuating axis.

Preferably, the further winder comprises a further first electric motor active on said further actuating rod to move said further actuating rod along the further actuating axis.

Preferably, the further winder comprises a further second electric motor active on said further tubular shaft to move said further tubular shaft along the further approach axis.

Preferably, said control unit is configured to drive the further first electric motor and the further second electric motor.

Preferably, the further approach axis is parallel to said approach axis. Preferably, the further approach axis is also coaxial with said approach axis. Preferably, the further actuating axis is parallel to said actuating axis.

Preferably, the further actuating axis is also coaxial with said actuating axis.

BRIEF DESCRIPTION OF THE DRAWINGS

Further features and advantages of the present invention will become clearer from the following detailed description of a preferred embodiment thereof, with reference to the appended drawings and provided by way of indicative and non-limiting example, in which.

DETAILED DESCRIPTION

In the appended figures, a wrapping device for product wrappers in accordance with the present invention is generically referred to by the numerical reference 1.

Figure 1:
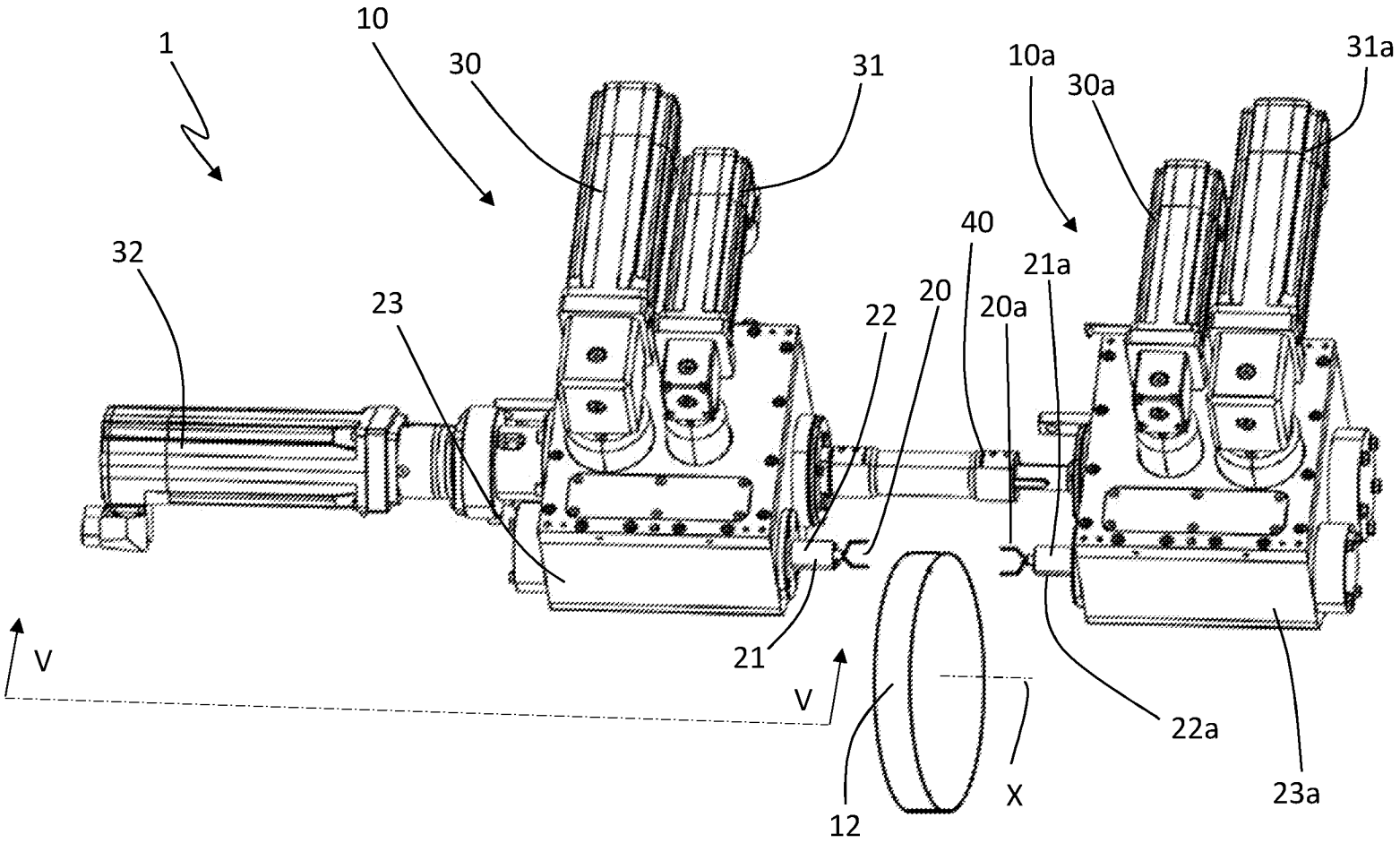
FIG. 1 is a schematic perspective view of a wrapping device for product wrappers in accordance with the present invention in an opening condition.

The device 1 comprises a winder 10 shown on the left in FIG. 1 and a further winder 10*a* shown on the right in FIG. 1.

Arranged between the winder 10 and the further winder 10*a* is a feeder of products to be wrapped 12 (depicted only schematically) rotating about a rotation axis X. The feeder of products to be wrapped comprises a plurality of seats (not illustrated) in each of which a corresponding product to be wrapped, partially wrapped by a wrapper material, is arranged. Such wrapper material needs to be wound at one or both ends to form a twist or a pair of twists. The rotation of the feeder of products to be wrapped sequentially places the partially wrapped products between winder 10 and the further winder 10*a*.

The winder 10 and the further winder 10*a* are configured to make a corresponding twist on the product wrapper.

The winder 10 and the further winder 10*a* are arranged facing each other with the product feeder 12 arranged between them.

The winder 10 and the further winder 10*a* are structurally identical to each other, except as explicitly described below, and are arranged symmetrically with respect to an ideal plane perpendicular to the rotation axis X of the product feeder 12.

Therefore, what is described in relation to the winder 10 is identically valid for the further winder 10*a*. The components of the winder 10 are also present in the further winder 10*a* and are depicted in FIG. 1, where necessary, with corresponding reference numbers followed by the letter 'a'.

The winder 10 comprises a gripper 20 mounted at one end 21 of a tubular shaft 22. The tubular shaft 22 is mounted inside a containment body 23 from which the end 21 of the tubular shaft 22 emerges.

The further gripper 20*a*, the further tubular shaft 22*a*, the end 21*a* of the further tubular shaft 22*a* and the further containment body 23*a* of the further winder 10*a* are shown in FIG. 1.

Figure 3:
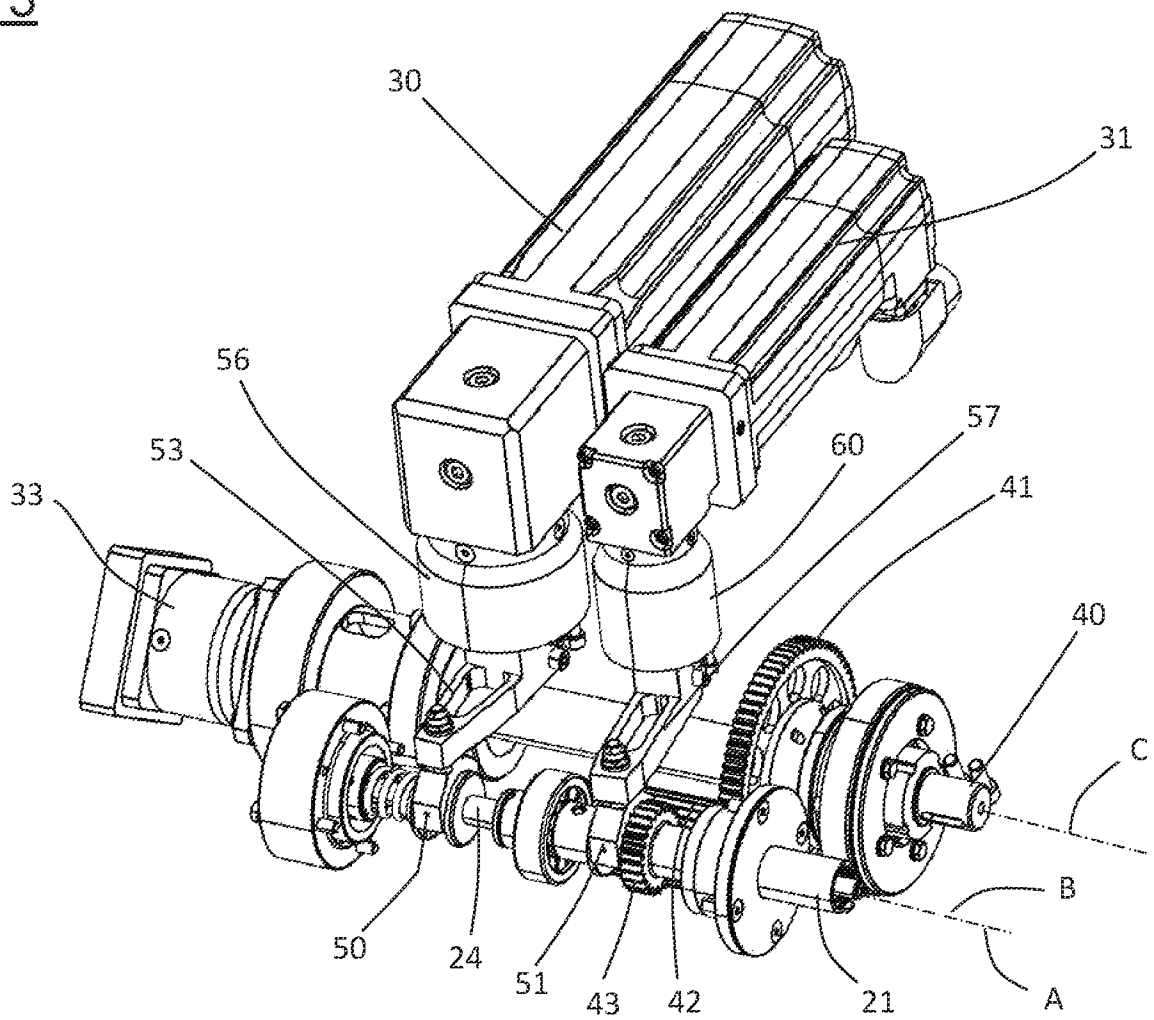
FIG. 3 is a schematic perspective view of some parts of the detail of the wrapping device of FIG. 2.
Figure 4:
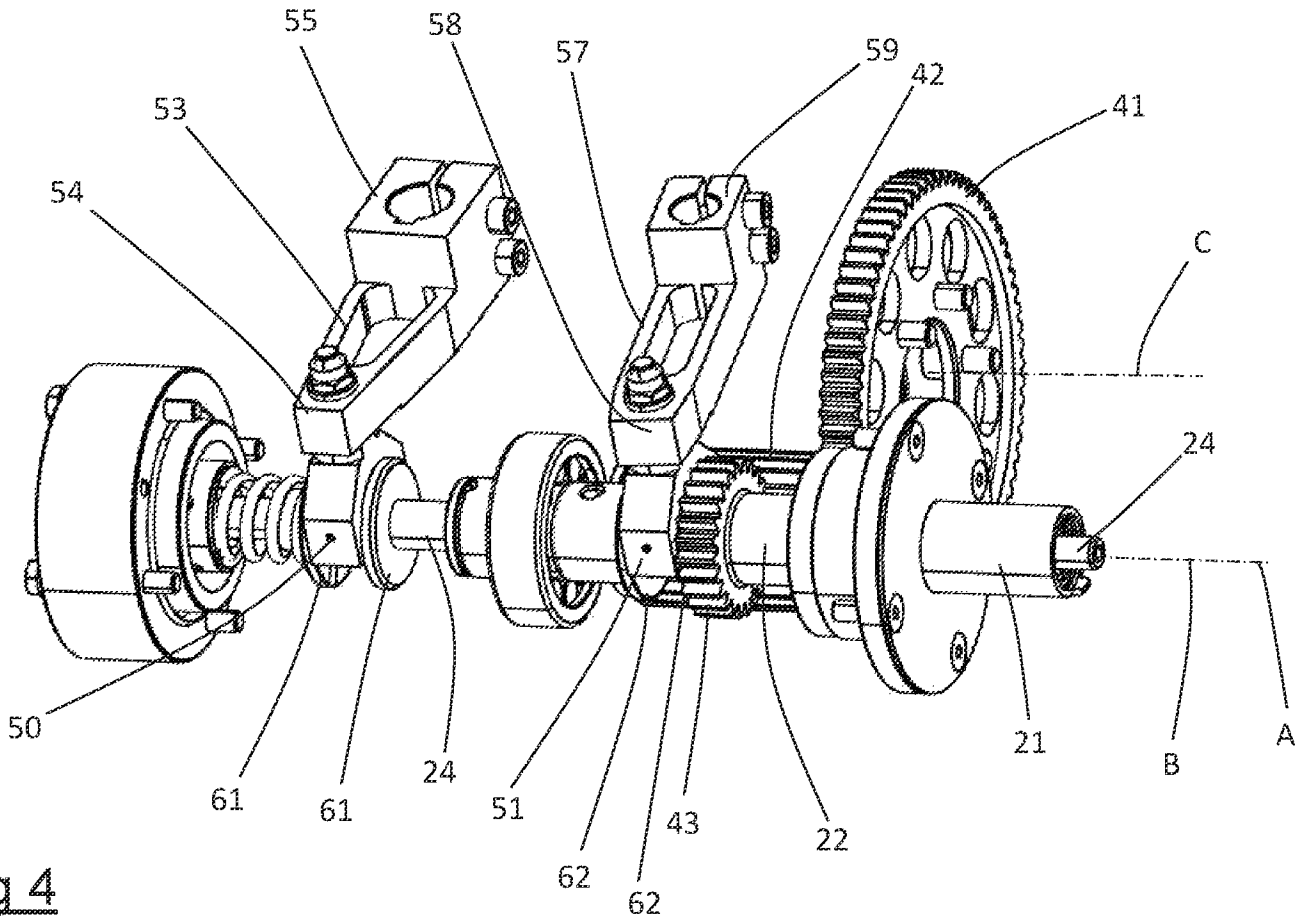
FIG. 4 is a schematic perspective view of further parts of the detail of the wrapping device of FIG. 2.

As better shown in FIG. 3, the tubular shaft 22 is rotatably mounted inside the containment body 23 (not shown in FIG. 3) to rotate about an approach axis A.

An actuating rod 24 is inserted inside the tubular shaft 22, which is rotationally integral with the tubular shaft 22 through, for example, a pin or shape coupling.

The actuating rod 24 also rotates about the approach axis A.

The tubular shaft 22 also slides along the approach axis between a rearward and forward position. In the rearward position, the end 21 of the tubular shaft 22 is distanced from the feeder 12 of products to be wrapped, and in the forward position the end 21 of the tubular shaft 22 is moved closer to the feeder 12 of products to be wrapped.

The actuating rod 24 slides along an actuating axis B coincident with the approach axis A. The actuating rod 24 slides inside the tubular shaft 22 and with respect to the tubular shaft 22. The actuating rod 24 slides along the actuating axis B between a rearward and forward position. When the actuating rod 24 is in the forward position, one end 25 of the actuating rod 24 protrudes more from the end 21 of the tubular shaft 22 with respect to when the actuating rod 24 is in the rearward position.

A first electric motor 30 is provided to drive the translation of the actuating rod 24 along the actuating axis B with respect to the tubular shaft 22.

A second electric motor 31 is provided to drive the translation of the tubular shaft 22 along the approach axis A.

A third electric motor 32 is provided to drive the rotation of the tubular shaft 22 and the actuating rod 24 therewith.

Figure 2:
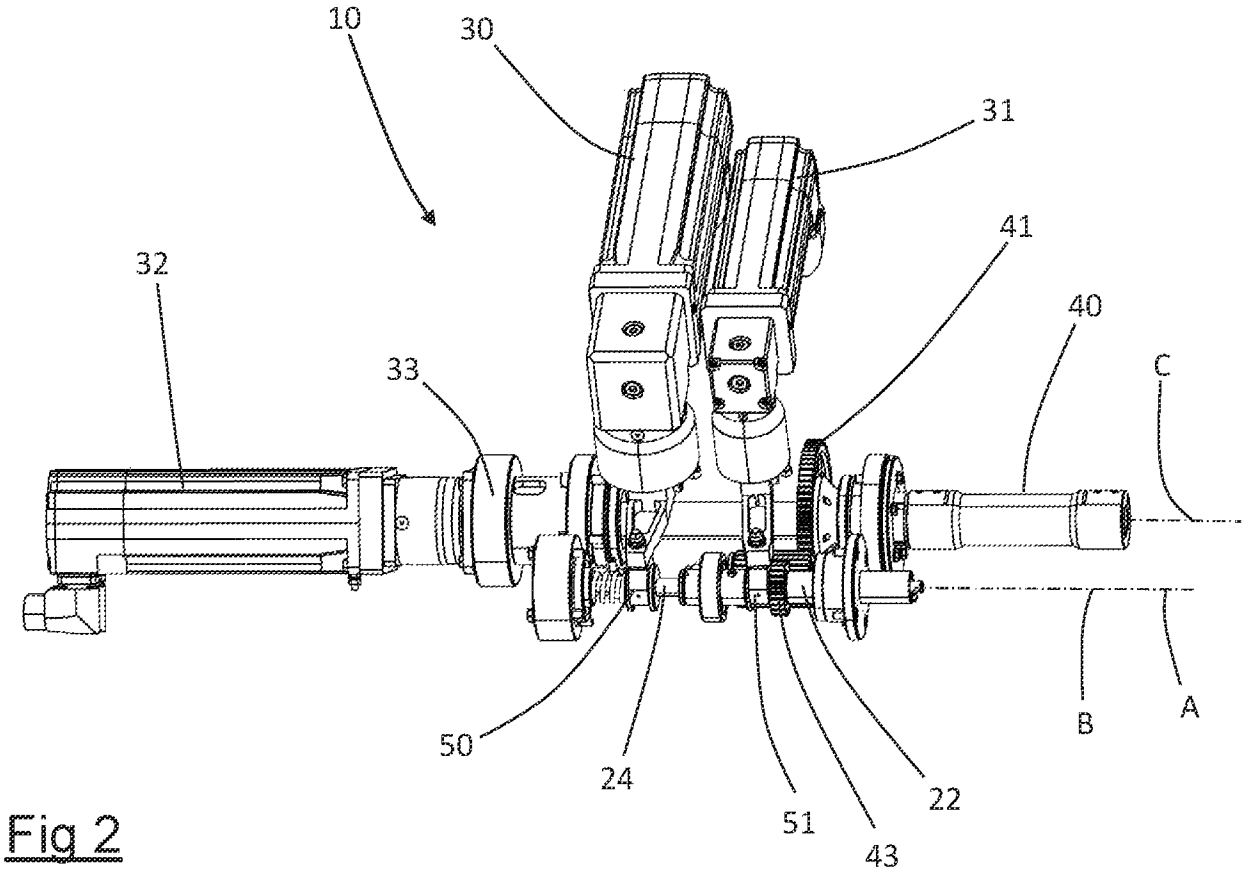
FIG. 2 is a schematic perspective view of a detail of the wrapping device of FIG. 1.

As shown in FIG. 2, the third electric motor is connected to a transmission shaft having a rotation axis C parallel to and spaced from the approach axis A.

In the preferred embodiment of the invention, a drive shaft of the third electric motor 32 is connected to a speed reducer 33. The speed reducer 33 is connected via an input shaft to the transmission shaft of the third electric motor 32 and via an output shaft to the transmission shaft 40. The function of the speed reducer 33 is to rotate the transmission shaft 40 at a different speed (preferably lower) than the rotation speed of the motor shaft of the third electric motor 32.

A pinion 41 is keyed to the transmission shaft 40, which rotates integrally with the transmission shaft 40. The pinion 41 is geared with a toothed roller 42 having a rotation axis D parallel to the rotation axis of the transmission shaft 40.

The toothed roller 42 is also geared with a gear 43 keyed to the tubular shaft 22.

The rotation of the transmission shaft 40 results in a rotation of the tubular shaft 22.

Both the pinion 41, toothed roller 42 and gear 43 are spurred, so that gear 43 can translate along the approach axis A (together with the tubular shaft 22) without losing engagement with the toothed roller 42. The dimension along the rotation axis D of the toothed roller 42 is greater than the maximum translation length of the tubular shaft 22 along the approach axis A.

The third electric motor 32 also drives the rotation of the further tubular shaft 22*a* and the further actuating rod of the further winder 10*a*.

In this regard, as shown in FIG. 1, the transmission shaft 40 extends between the winder 10 and the further winder 10*a* until it reaches the further winder 10*a*. At the further winder 10*a*, the transmission shaft comprises a further pinion geared with a further toothed roller which is geared with a further pinion keyed to the further tubular shaft 22*a*.

As described above, a first electric motor 30 is provided to drive the actuating rod 24 along the actuating axis B.

In this regard, the first electric motor 30 is active on a first fork 50 which is integral along the actuating axis to the actuating rod 24. The actuating rod 24 rotates about the actuating axis B with respect to the first fork 50. The first fork 50 comprises a through opening slidingly crossed by the actuating rod 24. The first fork comprises a shoulder in sliding contact against two abutments 61 integral with the actuating rod 24 and placed on the opposite side with respect to the through opening.

When the first fork 50 is moved by the first electric motor 30 along the actuating axis B, the shoulder of the fork exerts a force against one of the two abutments 61 integral with the actuating rod 24, causing the actuating rod to translate along the actuating axis B.

Similarly, the second electric motor 31 is active on a second fork 51 which is integral along the approach axis A to the tubular shaft 22. The tubular shaft 22 rotates about the approach axis A with respect to the second fork 51. The second fork 51 comprises a through opening slidingly crossed by the tubular shaft 22. The second fork 51 comprises a shoulder in sliding contact against two abutments 62 integral with the actuating shaft 22 and placed on the opposite side with respect to the through opening.

When the second fork 51 is moved by the second electric motor 31 along the approach axis A, the shoulder of the second fork exerts a force against one of the two abutments 62 integral with the tubular shaft 22, causing the translation of the tubular shaft 22 along the approach axis A. During such translation, the pinion 43 translates with respect to the toothed roller 42 without losing engagement therewith.

In a first embodiment shown in the accompanying figures, the first electric motor drives the first fork 50 via a first control rod 53. In this embodiment, the first electric motor 30 comprises a rotating drive shaft. The first electric motor 30 generates a mechanical moment on the rotating drive shaft, rotating the latter.

The first control rod 53 comprises a first end 54 hinged to the first fork 50 around a hinge axis perpendicular to the actuating axis B.

The first control rod 53 comprises a second end 55 opposite the first end 55 stably connected to the output shaft of a speed reducer 56. The speed reducer 56 comprises an input shaft connected to the drive shaft of the first electric motor 30. The function of the speed reducer 56 is to rotate the first control rod 53 at a different speed (preferably lower) than the rotation speed of the drive shaft of the first electric motor 30.

When the first electric motor 30 is driven to rotate in a first angular direction, the first control rod 53 rotates concordantly in the same angular direction. The first control rod 53 sets the first fork 50 in motion in a first direction along the actuating axis B. Such a first direction is directed towards the forward position of the actuating rod 24. The first fork 50 drags the actuating rod 24 towards the forward position in translation.

When the first electric motor 30 is driven to rotate in a second angular direction, the first control rod 53 rotates concordantly in the same angular direction. The first actuating rod 53 sets the first fork 50 in motion in a second direction along the actuating axis B. Such a second direction is directed towards the rearward position of the actuating rod 24. The first fork 50 drags the actuating rod 24 towards the rearward position in translation.

In the first embodiment, the second electric motor 31 drives the second fork 51 via a second control rod 57. The second electric motor 31, similar to the first electric motor 30, comprises a rotating drive shaft. The second electric motor 31 generates a mechanical moment on the rotating drive shaft, rotating the latter.

The second control rod 57 comprises a first end 58 hinged to the second fork 51 about a hinge axis perpendicular to the approach axis A.

The second control rod 57 comprises a second end 59 opposite the first end 58 permanently connected to the output shaft of a speed reducer 60. The speed reducer 60 comprises an input shaft connected to the drive shaft of the second electric motor 31. The function of the speed reducer 60 is to set the second control rod 57 rotating at a different speed (preferably lower) than the rotation speed of the drive shaft of the second electric motor 31.

When the second electric motor 31 is driven to rotate in a first angular direction, the second control rod 57 rotates concordantly in the same angular direction. The second control rod 57 sets the second fork 51 in motion in a first direction along the approach axis A. Such a first direction is directed towards the forward position of the tubular shaft 22. The second fork 51 drags the tubular shaft 22 towards the forward position in translation.

When the second electric motor 31 is driven to rotate in a second angular direction, the second control rod 57 rotates concordantly in the same angular direction. The second control rod 57 sets the second fork 51 in motion in a second direction along the approach axis A. This second direction is directed towards the rearward position of the tubular shaft 22. The second fork 51 drags the tubular shaft 22 towards the rearward position in translation.

In a second embodiment not illustrated, the first electric motor is a linear electric motor and comprises a translatable drive shaft. The linear electric motor produces a force on the motor shaft which sets the motor shaft in motion along a straight trajectory, either in a first direction or in a second direction opposite to the first.

The translation direction of the drive shaft is parallel and preferably coincident with the actuating axis B.

The drive shaft is connected, either directly or via a return, to the first fork 50.

When the first electric motor 30 is driven to translate the drive shaft in a first direction, the drive shaft sets the first fork 50 in motion in a first direction along the actuating axis B. Such a first direction is directed towards the forward position of the actuating rod 24. The first fork 50 drags the actuating rod 24 towards the forward position in translation.

When the first electric motor 30 comes to translate the drive shaft in a second direction, the drive shaft sets the first fork 50 in motion in a second direction along the actuating axis B. Such a second direction is directed towards the rearward of the actuating rod 24. The first fork 50 drags the actuating rod 24 towards the rearward position in translation.

In the second embodiment, the second electric motor is a linear electric motor and comprises a translatable drive shaft. The linear electric motor produces a force on the motor shaft which sets the motor shaft in motion along a straight trajectory, either in a first direction or in a second direction opposite to the first.

The translation direction of the drive shaft is parallel and preferably coincident with the approach axis A.

The drive shaft is connected, either directly or via a return, to the second fork 51.

When the second electric motor 31 is driven to translate the drive shaft in a first direction, the drive shaft sets the second fork 51 in motion in a first direction along the approach axis A. Such a first direction is directed towards the forward position of the tubular shaft 22. The second fork 51 drags the tubular shaft 22 towards the forward position in translation.

When the second electric motor 31 comes to translate the drive shaft in a second direction, the drive shaft sets the second fork 51 in motion in a second direction along the approach axis A. Such a second direction is directed towards the rearward position of the tubular shaft 22. The second fork 51 drags the tubular shaft 22 towards the rearward position in translation.

The gripper 20 is integral for translations along the approach axis A to the tubular shaft 22 while the actuating rod 24 is sliding along the actuating axis B with respect to the gripper 20.

The function of the tubular shaft 22 is to rotate and move the gripper 20 towards and away from the product to be wrapped. The purpose of the actuating rod 34 is to open and close the gripper 20.

Figure 5:
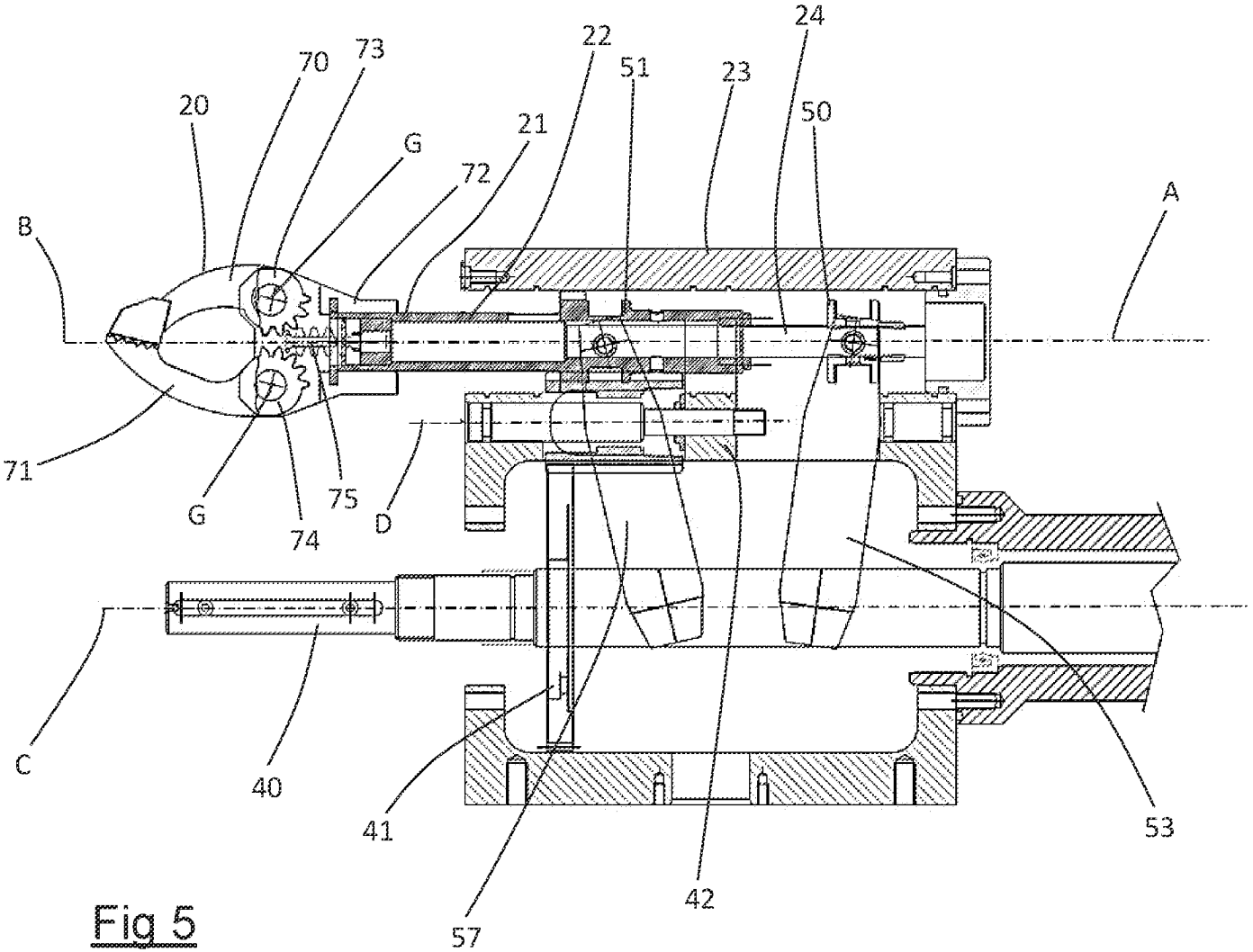
FIG. 5 depicts a schematic sectional view in the plane V-V of a part of the wrapping device of FIG. 1.

The gripper 20 comprises (see FIG. 5) a first jaw 70 and a second jaw 71. The first jaw 70 and the second jaw 71 are rotatably mounted about a respective clamping axis G on a gripper body 72. The gripper body 72 is constrained to the end 21 of the tubular shaft 22 and comprises a through opening through which the actuating rod 24 is slidingly inserted.

The first jaw 70 comprises a first toothed wheel 73 hinged in the respective clamping axis G of the first jaw.

The second jaw 71 comprises a second toothed wheel 74 hinged in the respective clamping axis G of the second jaw.

The first toothed wheel 73 and the second toothed wheel 74 are permanently engaged on a rack 75 placed at one end of the actuating rod 24.

The translation of the actuating rod 24 along the actuating axis B causes a translation of the rack 75 and a consequent rotation of the first toothed wheel 73 and the second toothed wheel 74 in opposite angular directions.

The rotation in opposite angular directions of the first toothed wheel 73 and the second toothed wheel 74 results in respective rotations of the first jaw 70 and the second jaw 71 of the gripper 20.

A translation of the actuating rod 24 towards the forward position corresponds to rotations of the first jaw 70 and second jaw 71 which close or tend to close the gripper 20.

A translation of the actuating rod 24 towards the rearward position corresponds to rotations of the first jaw 70 and second jaw 71 which open or tend to open the gripper 20.

Figure 6:
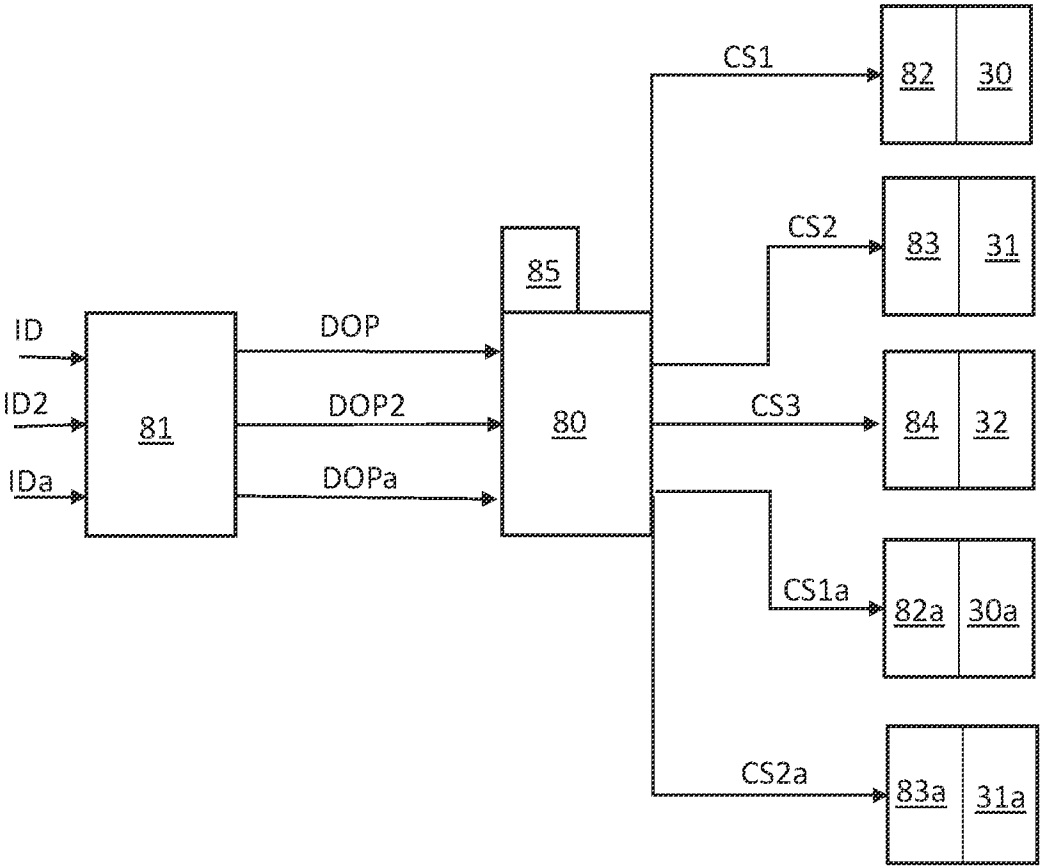
FIG. 6 is a block diagram representative of some components of the wrapping device for product wrappers in accordance with the present invention.

In order to coordinate the movements of the first electric motor 30 and the second electric motor 31, the device 1 comprises a control unit 80 (diagrammed in FIG. 6).

The control unit 80 is associated with a user interface 81 (also diagrammed in FIG. 6).

The user interface 81 is configured to receive at least one input datum ID representing a desired operating parameter DOP of the gripper 20.

Such a desired operating parameter SOP is a parameter which identifies a user-desired behaviour of the gripper 20 during its operation in a twist closing process of the end of the wrapper. Such a desired behaviour can be changed by the user by changing the input data ID according to specific usage requirements.

By way of example, such a desired operating parameter DOP can be the translation distance which the tubular shaft 20 must travel during a translation along the approach axis A towards the forward position. In this case, the desired operating parameter SOP is related to the distance at which the gripper 20 is to be brought to the start of the operation to create the twist closure.

A further example of such a desired operating parameter DOP can be the translation distance which the tubular shaft 20 must travel during a translation along the approach axis A to the rearward position. In this case, the desired operating parameter DOP is related to the distance at which the gripper 20 is to be brought at the end of the operation to create the twist closure.

A further example of such a desired operating parameter DOP can be the point, along the approach axis A and during translation of the tubular shaft toward the forward position, at which a closing movement of the first jaw 70 and the second jaw 71 of the gripper 20 begins.

Another example of such a desired operating parameter DOP can be the point, along the approach axis A and during the movement of the tubular shaft toward the rearward position, at which an opening movement of the first jaw 70 and the second jaw 71 of the gripper 20 begins.

Further examples of such a desired operating parameter DOP could be the point, along the approach axis A, at which an opening movement of the first jaw 70 and the second jaw 71 ends or at which a closing movement of the first jaw 70 and the second jaw 71 ends.

Further examples of such a desired operating parameter DOP can be the distance travelled by the tubular shaft 22 along the approach axis A during which the complete closing of the first jaw 70 and the second jaw 71 occurs, or during which the complete opening of the first jaw 70 and the second jaw 71 of the gripper 20 occurs.

Other examples of such a desired operating parameter DOP could be the maximum rotation in opening of the first jaw 70 and the second jaw 71 or the maximum rotation in closing of the first jaw 70 and the second jaw 71 of the gripper 20.

Another example of such a desired operating parameter DOP can be the clamping torque of the first jaw 70 and the second jaw 71 of the gripper 20.

In the preferred embodiment of the invention, the user interface 81 is configured to receive a plurality of input data ID each representative of a desired operating parameter DOP of the gripper 20.

The control unit 80 is configured at hardware, software and/or firmware level to obtain the desired operating parameters DOP from the input data ID and determine a gripper 20 law of motion from the derived desired operating parameters DOP. The control unit comprises, for example, a processor 85 configured for this purpose.

Such a law of motion of the gripper 20 expresses, e.g., in respective position/time diagrams and/or in respective mathematical functions, the position of the gripper (or of a point representative of the position of the gripper 20) in time and the degree of opening and closing of first jaw 70 and second jaw 71 (or of points representative of the position of the first jaw 70 and second jaw 71) in time.

In a preferred embodiment, the control unit 80 is configured to determine the law of motion of the gripper 20 by interpolating the desired operating parameters DOP with preset operating parameters POP.

Such preset operating parameters POP are representative of positions which the gripper 20 must necessarily reach over time in order to obtain the desired behaviour.

The desired operating parameters DOP can be expressed in terms of a plurality of points representing the desired position of the gripper 20 in time and the desired position of the first jaw 70 and the second jaw 71 in time.

In turn, the preset operating parameters POP can be expressed in terms of a plurality of points representing the required position of the gripper 20 in time and the required position of the first jaw 70 and the second jaw 71 in time.

By interpolating the above points (both those representative of the desired position and those of the required position), it is possible, for example, to determine the law of motion of the gripper 20.

The control unit 80 is configured, once the law of motion of the gripper 20 has been determined, to break down such a law of motion into a first law of motion of the actuating rod 24 and a second law of motion of the tubular shaft 22.

The first law of motion of the actuating rod 24 and the second law of motion of the tubular shaft 22 are determined by the control unit 80 so that the simultaneous actuation of the actuating rod 24 according to the first law of motion and the tubular shaft 22 according to the second law of motion results in the actuation of the gripper 20 according to its law of motion.

The first law of motion expresses, e.g., in a position/time diagram and/or in a respective mathematical function, the position of the actuating rod 24 (or of a point representative of the position of the actuating rod 24) along the actuating axis B in time.

The second law of motion expresses, e.g., in a position/time diagram and/or in a respective mathematical function, the position of the tubular shaft 22 (or of a point representative of the position of the tubular shaft 22) along the approach axis A in time.

The control unit 80 is configured to generate a first control signal CS1 representing the first law of motion.

In particular, the first control signal CS1 represents the position of the actuating rod 24 (or of a point representative of the position of the actuating rod 24) along the actuating axis B in time.

The first control signal CS1 is sent to a driver 82 of the first electric motor 30 to actuate the first electric motor 30.

The control unit 80 is also configured to generate a second control signal CS2 representing the second law of motion.

In particular, the second control signal CS2 represents the position of the tubular shaft 22 (or a point representative of the position of the tubular shaft 22) along the approach axis A in time.

The second control signal CS2 is sent to a driver 83 of the second electric motor 31 to actuate the second electric motor 31.

The control unit 80 is also configured to generate a third control signal CS3 and send it to a driver 84 of the third electric motor 32.

The third control signal CS3 is generated so as to rotate the tubular shaft during the entire twist winding process of the end of the wrapper.

The third control signal CS3 can be calculated by the control unit 80 from a second input data ID2 entered in the user data entry interface 81. This second input data ID2 is representative of a desired rotation speed OP2 of the gripper 20 and the further gripper 20*a* when present.

The desired rotation speed DOP2 can be constant or variable in time.

In the event of twist winding both ends of the wrapper to obtain a double twist, the control unit 80 is configured to generate a further first control signal CS1*a* and an further control signal CS2*a* and send them to respective drivers 82*a*, 83*a* of the further first electric motor 30*a* and the further second electric motor 31*a* of the further winder 10*a*.

Such a further first control signal CS1*a* and further control signal CS2*a* are generated from a further at least one input data IDa entered into the user data entry interface 81 and representative of a further desired operating parameter DOpa of the further gripper 20*a* as described above.

In this case, said further desired operating parameter DOpa, in addition to the examples mentioned in connection with the operating parameter DOP, can also be the time lag between the start of the closing or opening of the further first jaw and further second jaw with respect to the opening or closing of the first jaw and second jaw.

In some embodiments, the further operating parameter DOpa and the operating parameter DOP can also be variable as a function of the desired set rotation speed DOP2.

The invention claimed is:

1. A wrapping device for product wrappers comprising:

a winder comprising:

a gripper mechanically connected to one end of a tubular shaft, wherein said tubular shaft is rotatable about an approach axis (A) and translatable along said approach axis (A), and wherein said gripper is rotatable and translatable integrally with said tubular shaft;

an actuating rod, configured to act on said gripper, sliding along an actuating axis (B) parallel to, or coinciding with, said approach axis (A), wherein said actuating rod slides along said actuating axis (B) with respect to said tubular shaft and is rotationally constrained to said tubular shaft, and wherein said gripper is openable and closable in response to a translation of said actuating rod along said actuating axis (B);

a first electric motor operating on said actuating rod to translate said actuating rod along the actuating axis (B);

a second electric motor operating on said tubular shaft to translate said tubular shaft along the approach axis (A);

said device further comprising a control unit configured to drive the first electric motor and the second electric motor;

wherein said winder comprises a first fork connected to a drive shaft of the first electric motor and constrained in translation along the actuating axis (B) to said actuating rod; said actuating rod being rotatable about said actuating axis (B) with respect to said first fork.

2. The wrapping device according to claim 1, comprising a third electric motor configured to act on said tubular shaft to rotate said tubular shaft about the approach axis (A); said control unit being configured to drive the third electric motor.

3. The wrapping device according to claim 2, comprising a transmission shaft connected to said third electric motor; a pinion being keyed to said transmission shaft to rotate with said transmission shaft; a spur gear being keyed on said tubular shaft and being directly or indirectly geared with said pinion.

4. The wrapping device according to claim 1, wherein said winder comprises a first control rod having a first end hinged to the first fork and a second end connected to a rotating drive shaft of the first electric motor; said first control rod moving the actuating rod along the actuating axis (B).

5. The wrapping device according to claim 4, wherein said drive shaft of the first electric motor is driven to rotate in a first angular direction to translate the actuating rod in a first direction along the actuating axis (B), and to rotate in a second angular direction opposite the first and translate the actuating rod in a second direction along the actuating axis (B).

6. The wrapping device according to claim 1, wherein said winder comprises a second fork connected to a drive shaft of said second electric motor and constrained in translation along the approach axis (A) to said tubular shaft; said tubular shaft being rotatable about said approach axis (A) with respect to said second fork.

7. The wrapping device according to claim 6, wherein said winder comprises a second control rod having a first end hinged to the second fork and a second end connected to a rotating drive shaft of the second electric motor; said second control rod moving the tubular shaft along the approach axis (A).

8. The wrapping device according to claim 7, wherein said drive shaft of the second electric motor is driven to rotate in a first angular direction to translate the tubular shaft in a first direction along the approach axis (A), and to rotate in a second angular direction opposite the first direction and translate the tubular shaft in a second direction along the approach axis (A).

9. The wrapping device according to claim 1, comprising a user data entry interface configured to receive at least one input data (ID) representative of a desired operating parameter (DOP) of the gripper.

10. The wrapping device according to claim 9, wherein said control unit is configured to determine a law of motion of the gripper starting from said at least one desired operating parameter (DOP).

11. The wrapping device according to claim 10, wherein said control unit is configured to interpolate said at least one desired operating parameter (DOP) with preset operating parameters (POP) and to determine said law of motion of the gripper from a result of said interpolation.

12. The wrapping device according to claim 10, wherein said control unit is further configured to determine, from said law of motion of the gripper, a first law of motion of the actuating rod and a second law of motion of the tubular shaft.

13. The wrapping device according to claim 12, wherein said control unit is configured to generate a first control signal (CS1) representative of the first law of motion and to send it to a driver of the first electric motor and to generate a second control signal (CS2) representative of the second law of motion and to send it to a driver of the second electric motor.

14. The wrapping device according to claim 1, further comprising a further winder comprising:

a further gripper mechanically connected to one end of a further tubular shaft, wherein said further tubular shaft is rotatable about a further approach axis and translatable along said further approach axis and wherein said further gripper is rotatable and translatable integrally with said further tubular shaft;

a further actuating rod, configured to act on said further gripper, sliding along a further actuating axis parallel to, or coinciding with, said further approach axis, wherein said further actuating rod is slidable along said further actuating axis with respect to said further tubular shaft and is rotationally constrained to said further tubular shaft, and wherein said further gripper is openable and closable in response to a translation of said further actuating rod along said further actuating axis;

a further first electric motor active on said further actuating rod to translate said further actuating rod along said further actuating axis;

a further second electric motor operating on said further tubular shaft to translate said further tubular shaft along the further approach axis;

said control unit being configured to drive the further first electric motor and the further second electric motor.

15. A wrapping device for product wrappers comprising:

a winder comprising:

a gripper mechanically connected to one end of a tubular shaft, wherein said tubular shaft is rotatable about an approach axis (A) and translatable along said approach axis (A), and wherein said gripper is rotatable and translatable integrally with said tubular shaft;

an actuating rod, configured to act on said gripper, sliding along an actuating axis (B) parallel to, or coinciding with, said approach axis (A), wherein said actuating rod slides along said actuating axis (B) with respect to said tubular shaft and is rotationally constrained to said tubular shaft, and wherein said gripper is openable and closable in response to a translation of said actuating rod along said actuating axis (B);

a first electric motor operating on said actuating rod to translate said actuating rod along the actuating axis (B);

a second electric motor operating on said tubular shaft to translate said tubular shaft along the approach axis (A);

said device further comprising a control unit configured to drive the first electric motor and the second electric motor;

said device further comprising a user data entry interface configured to receive at least one input data (ID) representative of a desired operating parameter (DOP) of the gripper, wherein said control unit is configured to determine a law of motion of the gripper starting from said at least one desired operating parameter (DOP) and wherein said control unit is configured to interpolate said at least one desired operating parameter (DOP) with preset operating parameters (POP) and to determine said law of motion of the gripper from a result of said interpolation.

16. A wrapping device for product wrappers comprising:

a winder comprising:

a gripper mechanically connected to one end of a tubular shaft, wherein said tubular shaft is rotatable about an approach axis (A) and translatable along said approach axis (A), and wherein said gripper is rotatable and translatable integrally with said tubular shaft;

an actuating rod, configured to act on said gripper, sliding along an actuating axis (B) parallel to, or coinciding with, said approach axis (A), wherein said actuating rod slides along said actuating axis (B) with respect to said tubular shaft and is rotationally constrained to said tubular shaft, and wherein said gripper is openable and closable in response to a translation of said actuating rod along said actuating axis (B);

a first electric motor operating on said actuating rod to translate said actuating rod along the actuating axis (B);

a second electric motor operating on said tubular shaft to translate said tubular shaft along the approach axis (A);

said device further comprising a control unit configured to drive the first electric motor and the second electric motor;

said device further comprising a third electric motor configured to rotate the tubular shaft and the actuating rod; said third electric motor being connected to a transmission shaft, wherein the transmission shaft extends between the winder and a further winder comprising a further gripper.

* * * * *